US008149141B2

(12) United States Patent
Coulmeau et al.

(10) Patent No.: US 8,149,141 B2
(45) Date of Patent: Apr. 3, 2012

(54) METHOD FOR UPDATING AUDIO COMMUNICATION FREQUENCIES BETWEEN AIRCRAFT AND ATC STATIONS ON THE GROUND

(75) Inventors: François Coulmeau, Seilh (FR); Guy Deker, Cugnaux (FR)

(73) Assignee: Thales (FR)

( * ) Notice: Subject to any disclaimer, the term of this patent is extended or adjusted under 35 U.S.C. 154(b) by 1145 days.

(21) Appl. No.: 11/955,254

(22) Filed: Dec. 12, 2007

(65) Prior Publication Data

US 2009/0130982 A1 May 21, 2009

(30) Foreign Application Priority Data

Dec. 12, 2006 (FR) ..... 06 10819

(51) Int. Cl.
*G08B 21/00* (2006.01)

(52) U.S. Cl. ..... 340/945; 340/961; 342/36; 455/63.3; 455/404.2; 455/431; 455/440; 455/456.1; 455/457; 701/120

(58) Field of Classification Search ..... 340/905, 340/928, 988–995, 945, 961, 971; 455/431, 455/456.6, 63.3, 457, 456.1, 404.2, 440; 701/1–9, 200, 120, 301; 342/36
See application file for complete search history.

(56) References Cited

U.S. PATENT DOCUMENTS 6,282,417 B1 8/2001 Ward
6,664,945 B1 * 12/2003 Gyde et al. ..... 345/156
6,836,659 B2 * 12/2004 Gouillou ..... 455/431
2002/0009993 A1 1/2002 Dastrup et al.

* cited by examiner

*Primary Examiner* — Brent Swarthout
(74) *Attorney, Agent, or Firm* — Lowe Hauptman Ham & Berner, LLP

(57) ABSTRACT

The present invention relates to a method for automatically preparing an update of audio communication frequencies between aircraft and ATC stations on the ground, a method making it possible to reduce the communication time associated with the necessary frequency changes between control sectors, therefore limiting the frequency space requirement, and reducing the workload due to the manipulations and control of these frequency changes, both for the air traffic controllers and for the aircraft crews, and wherein the flight plan or the current trajectory followed by the aircraft is dynamically coupled with the geometry information of the control sectors overflown by the aircraft and that, thereby knowing the intersection points of the flight plan with the sector limits, the frequency changes and sector name are prepared before each change of sector, while warning the pilot of their imminence.

9 Claims, 2 Drawing Sheets

METHOD FOR UPDATING AUDIO COMMUNICATION FREQUENCIES BETWEEN AIRCRAFT AND ATC STATIONS ON THE GROUND

RELATED APPLICATIONS

The present application is based on, and claims priority from, French Application Number 06 10819, filed Dec. 12, 2006, the disclosure of which is hereby incorporated by reference herein in its entirety.

FIELD OF THE INVENTION

The present invention relates to a method for updating audio communication frequencies between aircraft and ATC (Air Traffic Control) stations on the ground.

BACKGROUND OF THE INVENTION

The increasing proportion of automation for twenty five years in aviation, both civil and military, is leading aircraft crews more and more to carry out tasks of anticipation and of monitoring of the execution of the mission and of the electronic flight management systems, and less and less to directly influence the primary aircraft flight controls.

This trend has been accentuated these last twenty years with the spread of onboard flight management systems (commonly called FMS).

These systems hold a large number of data:

- originating from sensors (GPS, VHF) for navigation,
- originating from databases (navigation databases) for generating the electronic flight plan,
- originating from performance databases for generating the predictions along the flight plan,
- originating from route instruction, constraint or strategy entries made manually by the crew (usually in order to initialize the computations) or automatically by digital data link coming from the airline or from control centres (ATC).

Amongst the frequent and repetitive tasks carried out by the crew so as to always benefit from the air traffic assistance and control services, there is the selection of the audio frequency on the VHF radio equipment which has to be done on each change of control sector. The transfer between sectors is carried out following the receipt of a flight instruction, hereafter called "clearance", received from the controller of the current sector for making contact with the next sector, at the boundary of two sectors. As long as the frequency reassignment has not been made by the current controller, the aircraft is his responsibility, even if he is geographically in another sector.

Because of the increasing number of aircraft per sector and of the physical limit to the aircraft that can be handled by one controller, the sectors are increasingly smaller, which induces a larger number of sectors and hence of frequencies to be contacted. This is made possible thanks to a recent increase in frequencies linked to the reduction from 25 kHz to 8.33 kHz of the spaces between the latter, despite the restricted size of the bandwidth available for audio aviation communications. Therefore, the work of frequency transfer is increasingly time-consuming both for the controller and for the pilot. Furthermore, these more frequent verbally-made frequency transfers cause an increase in communications and hence mechanically a congestion on the frequency that may prejudice the control instructions and safety communications.

This may cause very dangerous situations for the controller who "sees" an aircraft on his radar screen in his sector, but has no control of it because he does not have its frequency (and can therefore not communicate directly and rapidly with it). Currently, this problem is solved by organizing ATC control rooms so that the air traffic controllers of adjacent sectors are close together and can verbally remind a colleague that he has forgotten to transfer him an aircraft, or, even if he is in another centre, communicate with him via a telephone call.

Studies are currently being carried out to smooth the load of the controller, with the objective of optimizing the partitioning of the sectors, their combination and their division in a dynamic manner. Specifically, there exists, particularly in Europe, a real problem of frequency congestion and traffic density. The "transfer" messages form the majority of the communications between the ground and the aircraft even though they have little or no impact on the route followed.

During combinations of sectors (at night for example, several small sectors are combined into a single sector), it is necessary to rapidly warn each aircraft individually that it must change its frequency in order to match that of this new sector.

In the same manner, when the traffic in a sector becomes too heavy for a controller and a decision to divide the sector into two or more is made, it is necessary very rapidly to warn the aircraft that are approaching the newly created sector that they must change frequency.

Because the average number of aircraft per sector varies from 10 to 20 and communications are still verbal, there may be a considerable period of floating between two changes.

To this must be added the possibilities of forgetting, not understanding, line congestion, which all generate potential problems.

Because currently each frequency change gives rise to four verbal messages: one from the controller of sector N to assign the future frequency, followed by a response (check) from the pilot, followed by the pilot contacting the sector N+1 followed by the acquiescence of the controller N+1, problems of congestion, repetition, forgetting will necessarily play an increasing part, problems that are greatly amplified by the dynamic partition/combination of the sectors as is envisaged in Europe in the years following 2010 in order to improve the flexibility of the control sectors.

SUMMARY OF THE INVENTION

The subject of the present invention is a method for updating audio communication frequencies between aircraft and ATC stations on the ground, a method that makes it possible to reduce the workload due to verbal communication frequency changes both for the air traffic controllers and for the aircrews.

The method according to the invention is characterized in that the flight plan or the current trajectory followed by the aircraft is dynamically coupled with the audio frequency information, name and geometry of the control sectors traversed by the aircraft and that, thereby knowing the intersection points of the flight plan with the limits of the polyhedrons representing the sectors, the frequency changes are prepared before each change of sector, while warning the pilot of their imminence.

Therefore, the method of the invention consists in linking to the onboard FMS flight plan data on the control sectors (partition, frequencies), in a dynamic manner, transparent for the pilot, and in preparing the frequency changes, while warning the pilot, for example visually, of their imminence. This solves the problems of number of messages exchanged, of the time that is spent exchanging them and that is detrimental in workload, of errors on inputting the new frequency and of forgetting a transfer or of a late transfer.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

The method of the invention proceeds as follows. An aircraft being in flight in a given sector for which it is in communication with the corresponding control centre, the frequency and the identifier of the next control sector are prepared and displayed according to the position of the aircraft relative to the transition points between the control sectors.

The control sectors are three-dimensional polyhedrons. They may therefore be defined geometrically, knowing the 3D coordinates (latitude, longitude, altitude) of the characteristic points. The example schematized in FIG. 1 shows in a simplified manner the partition of the air space to which the control zones correspond.

Figure 1:
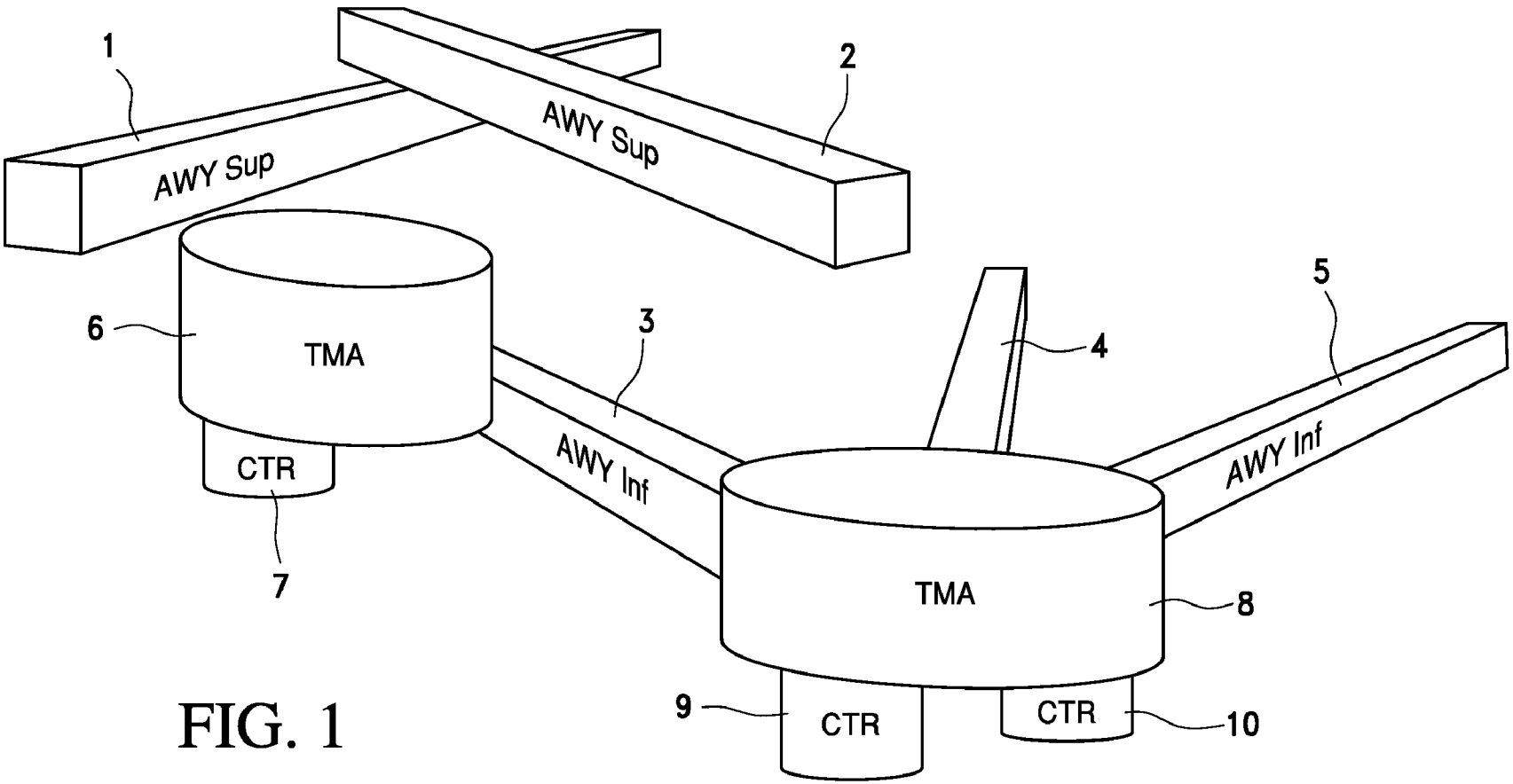
FIG. 1 is a simplified diagram of an example of the partition of air space serving to explain the details of how the method of the invention is applied.

FIG. 1 shows several "sky highways" (commonly called "Airways" or in abbreviation AWYs), namely two sections of upper airways ("AWY Sup") 1 and 2, and three sections of lower airways ("AWY Inf") 3, 4 and 5. Sections 1 to 5 are managed by the "EN ROUTE" control centres. For the aircraft climbing to this EN ROUTE portion, or descending from this EN ROUTE portion, the control zone is materialized by a "terminal zone" 6 ("Terminal Area" or abbreviated to TMA). For aircraft on take-off/landing, under the TMA, management is handled from zones called CTRs (Control Terminal Regions) 8.

The CTRs are linked to the airports. Their activities are essentially activities of controlling departures/arrivals. The TMAs include several airports and carry out both a lateral and vertical control while separating the aircraft.

The "EnRoute" centres manage the aircraft in the upper space, essentially laterally.

The method of the invention comprises three main steps:

1) defining on board or on the ground the portion of route where the frequency change may/must occur,
2) the transfer of this information to the aircraft if it is determined on the ground,
3) the on-board monitoring of the position of the aircraft relative to these points and the display of the data with or without a visual alarm.

In detail, these three steps are carried out as follows:

Definition of the portion of route where the frequency change may/must occur:

This portion is limited by two points: release point (PL) and transfer point (PT):

PL=the earliest point or release point (releasing transfer) from which the trajectory of the aircraft no longer crosses other trajectories, allowing the controller who transfers the traffic to the next sector to reduce his control load. This point is usually the last point where there is a crossing of trajectories known by the ATC control centre. It is at the initiative of the controller who can decide whether or not to anticipate the transfer at this point. The definition of the releasing transfer points is computed on the ground by the management system of the air traffic controller according to the flight plans passing through his sector as defined by the collaborative traffic flow management (CTFM) system. It is then sent to the aircraft via data link. These points are optional.

PT=the latest point or transfer point from which the aircraft must theoretically be taken over by the controller of the next sector. This point is usually the intersection point common to the flight plan and to the two control sectors. The transfer points are defined in two possible ways:

on the ground, that is a long time in advance, and they are then stored in a database on board the aircraft, or defined by the air traffic controller according to his need and transmitted according to the CPDLC ("Controller to Pilot Data Link Communication") protocol over a digital ground-to-air data link. These points are then made available to the aircrew in two possible ways: either by refreshing the FMS database or by data up-link to the aircraft. This solution makes it possible to reduce the volume of data interchanged between the ground and the aircraft but supposes an aircraft to be on (or close to) its flight plan.

on board, by computation based on geometric data corresponding to the sectors. This solution is applicable irrespective of the position of the aircraft, but transfers the computation of the intersections to the aircraft (load of the on-board computer and volume of important interchanges) and supposes that the database contains these sectors.

Once these points have been transferred or computed on board, a dialogue between the FMS and the aircraft communication systems (Radios, CMU) is established to prepare the data of the next sector (identity, frequency of the next sector) placed on standby and to detect anomalies and warn the pilot in the event of a late change.

It should be noted that the existence of a possible transfer point preceding the transfer point allows the controller to delegate to the pilot in the medium-term future the responsibility for deciding on the opportune moment for the frequency change, which is particularly valuable for smoothing the workload of the pilot and of the controller. Furthermore, this anticipation of frequency change is compatible with a future automation of communications between ground and aircraft. The pilot will therefore no longer have to physically manage the display and frequency transfer, but he will content himself with speaking continuously on the sector change, and, if necessary, with approving this sector change, which reduces his workload and limits the head-down activities (particularly on approach where frequency changes are frequent in a phase where the pilot needs to be checking the outside of the cockpit)

2)-Ground-aircraft up-link communication: this is done with the aid of means called a digital data link using the CPDLC protocol.

3)-Monitoring of the position of the aircraft relative to these PL and PT points and displaying the data with or without a visual alarm as mentioned above. The purpose of these points is to anticipate the next communication frequency: before PL, the frequency and identity of the next sector are prepared (that is to say extracted from the database in which they have been stored and made so that the pilot can read them). Between PL and PT, these data are displayed on the communication interface (MCDU and/or CMU) on standby (if a frequency is already displayed or selected by the pilot, a simple visual alarm indicates to the pilot that a new frequency is available on standby (indicated for example by a blinking asterisk), but it is the pilot's responsibility to decide to display it and after deleting the previous existing standby value. When a PT is passed, these data, if they have not been displayed by the pilot, are displayed on standby, where necessary replacing the previous value, but the visual alarm is more marked than the simple alarm (for example by a blinking value).

Figure 2:
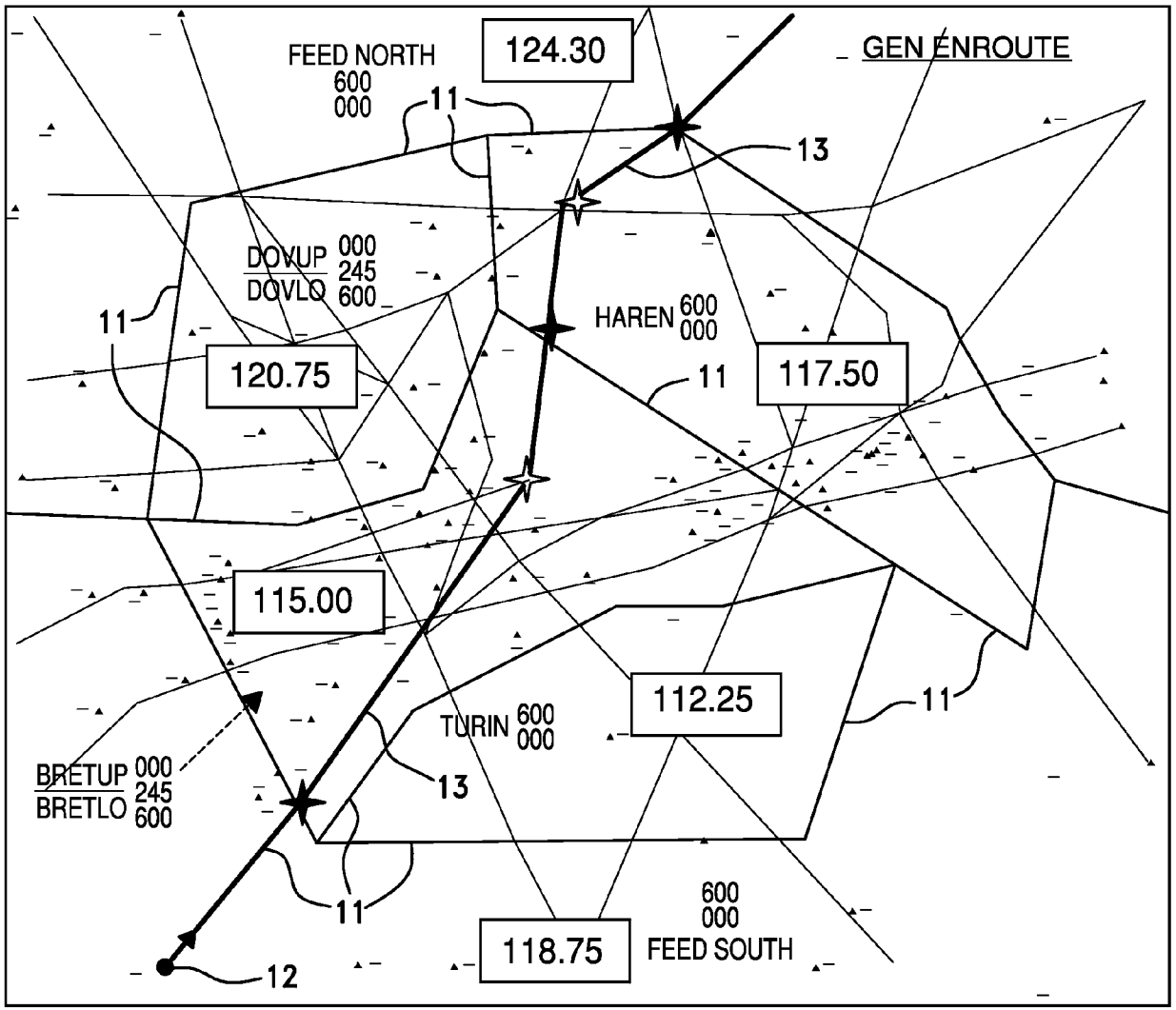
FIG. 2 is an example of a map showing air sectors on which are represented characteristic points determined using the method according to the present invention.

The way in which the method of the invention is applied will now be described with the aid of the example of FIG. 2. The transition points are defined according to one of the two processes explained below, depending on whether the corresponding computations are made on the ground by the computer of the control centre concerned:

Computations on the ground:

Initially, the computer on the ground searches for the intersections between the filed flight plan and the sectors, and it creates two points each time (PL and PT), as indicated in FIG. 2. The sectors are polyhedrons delimited by continuous lines 11. They are represented in 2D. The vertical separations are represented by the figures, for example "Bretigny Lower Airspace" (BRETLO) is valid between levels 000 (0 feet) and 245 (24500 feet) and "Bretigny Upper Airspace" (BRETUP) between levels 245 and 600. The frequencies associated with the sectors are expressed in MHz and represented in rectangles. For example, for TURIN, the VHF frequency for contact with control is 112.25 MHz. The aircraft is represented as 12. Its flight plan is indicated by a continuous thick line 13. The intersection points of the flight plan with the sectors (transfer) are indicated by the points PT1 to PT3, while the points PL2 and PL3 each indicate the place where the transfer can be initiated without risk of crossing the trajectory of another aircraft. In the example of FIG. 2, supposing the aircraft is at level 300, EN ROUTE, the sector changes are the following frequency transfer points (programmed close to the borders):

Moving from FEED SOUTH to BRETUP: Transfer point 1 (PT1)

Moving from BRETUP to HAREN: Transfer point 2 (PT2)

Moving from HAREN to FEED NORTH: Transfer point 3 (PT3)

These transfer points are combined with the frequency releasing transfer points (programmed after the last trajectory crossing) PL2 AND PL3.

All these points are sent to the aircraft by a digital data link in the Lat/Long format for example or relative to the flight plan (Place/Distance format relative to the flight plan point that follows the intersection or precedes it). The frequencies associated with the new sector are also transmitted in this way.

The point coordinates may be adjusted automatically so that the frequency transfer occurs slightly before or slightly after the intersection point, if required.

In the example of FIG. 2, when the radar of the controller detects an arrival of the aircraft on BRETUP coming from FEED SOUTH, the controller therefore decides to send all or part of the following data to the aircraft:

Identity and frequency associated with the BRETUP sector (for immediate display in case this information has not already been sent)

The coordinates of the transfer points PL2 and PT2 (Lat/Long) and the identity and frequency associated with the next sector (HAREN) for display conditional upon passing over the points.

For this, the method of the invention proposes using as a digital data link means the CPDLC application as described in the international regulations (SARPS ATN, document ICAO 9705, volume II). The messages according to this protocol may be written thus:

CONTACT [unitname] [frequency] (uM117) or:

AT [position] CONTACT [unitname] [frequency] (uM118) or:

AT [time] CONTACT [unitname] [frequency] (uM119) or:

MONITOR [unitname] [frequency] (uM120) or:

AT [position] MONITOR [unitname] [frequency] (uM121) or:

AT [time] MONITOR [unitname] [frequency] (uM122).

If a CONTACT [unitname] [frequency] or MONITOR [unitname] [frequency] message is received, the CMU positions the frequency on STANDBY and displays on the MCDU pages a message warning the pilot.

If a CONTACT or MONITOR message is associated with a position or a time (messages 118, 119, 121, 122 above), the flight management system creates this point based on the position coordinates (Insertion function of one point per Lat/Long) or based on the time (Time Marker function) and positions the point thus created and the corresponding frequency on the pilot display screen.

In the example of FIG. 2, the aircraft in the FEED SOUTH sector may receive the following messages from the ground:

AT [PT1] CONTACT [BRETUP][115.00]

AT [PL2] MONITOR [HAREN][117.50]

AT [PT2] CONTACT [HAREN][117.50]

AT [PL3] MONITOR [FEED NORTH][124.30]

AT [PT3] CONTACT [FEED NORTH][124.30]

When the aircraft FMS detects its passage over the point mentioned in the MONITOR message, it sends the frequency on Standby to the CMU and displays the "NEXT SECTOR FREQUENCY" message on the MCDU display ("Scratchpad") of the FMS. If there is already a standby frequency, the latter begins to blink or an asterisk begins to blink to indicate the arrival of a new standby frequency (so as not to overwrite a frequency entered by the pilot on standby).

When the FMS detects the passage of the aircraft over the point mentioned in the CONTACT message, it sends the frequency on StandBy to the CMU and displays the message "NEXT SECTOR: CHANGE FREQ" on the MCDU display of the FMS. If there is already a standby frequency, the latter is replaced by the new standby frequency.

According to the invention, when sectors are divided or combined, the computer on the ground sends to all the aircraft of the new sector a message of the type "CONTACT [unitname] [frequency]" comprising the new sector name and the new frequency. In this case, the FMS displays "NEW SEC- TOR: CHANGE FREQ" on the MCDU display and notifies the CMU that a new StandBy frequency is available.

Onboard computations:

The process applied on board is similar to that applied on the ground, but the data concerning the air sectors are this time fully transmitted on board: each polyhedron representing a sector traversed by an aircraft is transmitted in the following format:

Polyhedron name (for example: BRETUP)

Frequency (for example 115.00)

Number of polyhedron points (for example 9, for BRETUP)

Latitude and longitude coordinates of the points (Lat1/Long1, Lat2/Long2, . . . Lat9/Long9)

The FMS constructs the intersections between its flight plan and the polyhedrons to detect the entrances and exits of each polyhedron (for example for BRETUP: points PT1 and PT2), then it prepares the frequency on arriving at the sector in question. Therefore, the FMS in this case monitors only the frequency transfer points (and not the release points which can be defined only by the controller). The rest of the process is the same as the process relating to the computations made on the ground.

When sectors are divided or combined, the FMS verifies the position of the aircraft relative to the new polyhedrons representing the result of this change. It therefore detects whether the new frequency has changed. In this case, it prepares the new standBy frequency and displays for example: "NEW SECTOR: CHANGE FREQ" on the MCDU display.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalent thereof.

The invention claimed is:

1. A method for updating audio communication frequencies between an aircraft and ATC stations on the ground, the method comprising:

generating a flight plan or a current trajectory on board the aircraft followed by the aircraft;

dynamically coupling the flight plan or the current trajectory with geometry information of control sectors overflown by the aircraft;

determining intersection points of the flight plan with limits of polyhedrons representing the control sectors;

determining on board the aircraft or on the ground, position information corresponding to a portion of the flight plan or the current trajectory where a frequency change occurs based on the intersection points;

transferring the position information to the aircraft if the position information is determined on the ground;

monitoring on board the aircraft, a position of the aircraft relative to the portion of the flight plan or the current trajectory where the frequency change occurs; and displaying of the relative position and warning a pilot of an imminence of when the frequency change occurs, wherein, when sectors are divided or combined, a computer on the ground sends to all the aircraft of a new sector a message (CONTACT [unitname] [frequency]) with the new sector name and the new frequency.

2. The method according to claim 1, wherein the geometry information of the control sectors overflown by the aircraft are generated on board the aircraft.

3. The method according to claim 1, wherein the geometry information of the control sectors overflown by the aircraft are generated on the ground.

4. The method according to claim 1, wherein a user determines the portion of route in the flight plan of the aircraft for which the frequency change is be made, the portion of the route being delimited by a release point based on where the aircraft trajectory no longer crosses other trajectories, and a transfer point based on where the aircraft must be taken over by a controller of a next sector.

5. The method according to claim 4, wherein the release points and the transfer points are defined by a control station computer on the ground.

6. The method according to claim 4, wherein the release points and the transfer points are defined by a computer of the aircraft.

7. The method according to claim 4, wherein, before each release point, the frequency and an identity of the next sector are extracted from a database and made so that the pilot can read the frequency and the identity.

8. The method according to claim 7, wherein, between a release point and the transfer point of the same sector, the frequency and the identity of the next sector are displayed on standby on a display interface of the pilot and a simple visual alarm tells the pilot that a new frequency is available on standby.

9. A method for updating audio communication frequencies between an aircraft and ATC stations on the ground, the method comprising:

generating a flight plan or a current trajectory on board the aircraft followed by the aircraft;

dynamically coupling the flight plan or the current trajectory with geometry information of control sectors overflown by the aircraft;

determining intersection points of the flight plan with limits of polyhedrons representing the control sectors;

determining on board the aircraft or on the ground, position information corresponding to a portion of the flight plan or the current trajectory where a frequency change occurs based on the intersection points;

transferring the position information to the aircraft if the position information is determined on the ground;

monitoring on board the aircraft, a position of the aircraft relative to the portion of the flight plan or the current trajectory where the frequency change occurs; and displaying of the relative position and warning a pilot of an imminence of when the frequency change occurs, wherein, when sectors are divided or combined, an onboard flight management system (FMS) verifies the position of the aircraft relative to new polyhedrons representing a result of the divided or combined sectors and if a frequency has changed, the onboard FMS prepares a new standby frequency and displays a corresponding message on a display of the pilot.

* * * * *